US007993110B1

(12) United States Patent
Hill

(10) Patent No.: US 7,993,110 B1
(45) Date of Patent: Aug. 9, 2011

(54) STEAM-GENERATOR AND GAS-COMPRESSOR SYSTEMS USING WATER-BASED EVAPORATION COOLANTS, SEALANTS AND LUBRICANTS

(76) Inventor: Gilman A. Hill, Englewood, CO (US)

( * ) Notice: Subject to any disclaimer, the term of this patent is extended or adjusted under 35 U.S.C. 154(b) by 1001 days.

(21) Appl. No.: 11/899,905

(22) Filed: Sep. 8, 2007

Related U.S. Application Data

(63) Continuation-in-part of application No. 11/455,438, filed on Jun. 19, 2006, and a continuation of application No. 11/510,751, filed on Aug. 26, 2006, and a continuation-in-part of application No. 11/856,677, filed on Aug. 27, 2007.

(60) Provisional application No. 60/840,831, filed on Aug. 28, 2006, provisional application No. 60/921,620, filed on Apr. 1, 2007.

(51) Int. Cl.
*F04B 3/00* (2006.01)

(52) U.S. Cl. ..... 417/251; 417/297; 62/179; 210/748.01

(58) Field of Classification Search ..... 417/251, 417/297; 62/179; 210/748.01
See application file for complete search history.

(56) References Cited

U.S. PATENT DOCUMENTS 6,506,027 B1 * 1/2003 Timuska ..... 417/251

* cited by examiner

*Primary Examiner* — Walter D Griffin
*Assistant Examiner* — Cameron J Allen
(74) *Attorney, Agent, or Firm* — Edwin H. Crabtree; Ramon L. Pizarro

(57) ABSTRACT

A gas/air compressor system used for compressing a gas/air stream of air, oxygen, oxygen-enriched air and other combustible gases and delivering a moderate-to-high temperature, moderate-to-high pressure fluid to a pipeline connected to one or more injection wells. Fuel with cooling water is injected downhole for combustion in the compressed gas/air stream to be used for in-situ-retorting of oil shale, volatile coal beds, tar sands, heavy oil and other hydrocarbon or carbonaceous deposits. A preferred embodiment of the compressor system includes a compressor housing with a male screw rotor having helical lobes received in helical grooves in a female screw rotor. The housing includes a gas/air inlet for receiving the gas/air stream therein and a series of water/mineral injectors for injecting a water/mineral slurry into the rotating screw rotors. The water/mineral slurry acts as a sealant, a lubricant and also a coolant for male and female screw rotors during the compression cycle. The slurry is non-combustible and non-reactive to combustion-supporting gases. Also, the housing includes a gas/air outlet for discharging the compressed gas/air stream into the pipeline connected to the injection wells used in the in-situ-retorting process.

23 Claims, 4 Drawing Sheets

STEAM-GENERATOR AND GAS-COMPRESSOR SYSTEMS USING WATER-BASED EVAPORATION COOLANTS, SEALANTS AND LUBRICANTS

This a Continuation-In-Part Patent Application of a prior Utility patent application, titled "Integrated In Situ Retorting And Refining Of Oil Shale," filed on Jun. 19, 2006, Ser. No. 11/455,438, by Gilman A. Hill and Joseph A. Affholter, a prior Continuation patent application of a prior Utility patent application, titled "Integrated In Situ Retorting and Refining of Heavy-Oil and Tar Sand Deposits", as filed on Aug. 26, 2006, Ser. No. 11/510,751, by Gilman A. Hill and Joseph A. Affholter, and a prior, Continuation-In-Part Utility patent application, titled "Gas/Air-Compressor and Steam Generator Systems," filed Aug. 27, 2007, Ser. No. 11/856,677, by Gilman A. Hill.

Also, the applicant/inventor claims the benefit of a Provisional patent application, titled "Air/Gas Compressor System", as filed on Aug. 28, 2006, Ser. No. 60/840,831, by Gilman A. Hill, and claims the benefit of a Provisional patent application, titled "Operational Procedures For Accelerated Oil-Shale Production Development System," as filed on Apr. 1, 2007, Ser. No. 60/921,620, by Gilman A. Hill.

BACKGROUND OF THE INVENTION (a) Field of the Invention

The subject invention pertains to the use of moderate-to-low-RPM, twin-screw, rotary gas/air compressor system with continuous, water-evaporation cooling of a gas throughout all or part of it's compression cycle. The compressor system may use an inorganic, water/mineral slurry, or a non-combustible, organic lubricant emulsified into a water base, as an evaporative coolant, and a compression-cavity's partial sealant and lubricant. For compression of air, oxygen, oxygen-enriched air, or other combustion-support gases, sealants or lubricants must be of non-combustible and non-reactive materials. Such materials may consist of a water dispersion of inorganic minerals, like bentonite and related clay minerals, colloidal glacial silt, silica gel, mica, etc., a water dispersion of synthetic, inorganic, spherical particles, acting as micro-ball-bearings, or a non-combustible lubricant, colloidally dispersed or emulsified into a water base. The water in such sealant and lubricating dispersions will undergo continuous and rapid evaporation, and must be replaced by continuous water injection in order to maintain sufficient slurry sealant and lubricant consistency and volume. The compressed outlet gas consists of the inlet gas composition plus the commingled volume of steam created by the evaporation of water used for this continuous evaporative cooling.

The subject gas/air compressor system is designed to compress a moderate-to-high-temperature, moderate-to-high-pressure, thermal-energy carrier fluid (TECF). From the compressor system, the TECF carrier fluid may be transmitted to a series of injection wells and then into underground permeable geologic zones for production of in-situ-retorted-and-hydrocracked products derived from fixed-bed carbon deposits (FBCD), such as oil shale, volatile coal beds, tar sands, heavy-oil deposits, carbonaceous shale, etc., with such products produced through a series of production wells.

The subject gas/air-compressor system may be designed to use saline-water solutions with a controlled rate of increasing dissolved minerals in the evaporating-water solution without leaving any precipitation or scaling deposits within the compressor. Furthermore, the water solutions, with increased-dissolved-mineral content exiting from such a compressor system, can be depressurized in a manner to control the precipitation of mineral salts for possible recovery of valuable mineral by-products.

(b) Discussion of Prior Art

Heretofore, prior gas-compression technology has generally used multiple stages of near adiabatic gas compression with inter-stage coolers to control compressed-gas temperatures. Such inter-stage coolers generally use heat-transfer coils of coolant to provide the transfer of thermal energy of hot, compressed gas through the walls of such coils and into an independent, circulated coolant. However, a water-injection, evaporative-cooling technology can be used in such inter-stage coolers between the near adiabatic compression stages. Also, centrifugal turbine compressors or axial-flow turbine compressors have been commonly used for such near adiabatic-compression stages with inter-stage cooling.

None of the above mentioned, prior-art, compressed-air-and-gas technology specifically uses compression systems with a continuously injected, liquid-water phase to provide internal, water-evaporation cooling in the compression process. If limited-volume, internal-water-evaporation cooling is attempted in centrifugal turbine compressors, or in axial-flow turbine compressors, mineral-salt precipitation and scaling would occur unless very pure mineral water is used.

SUMMARY OF THE INVENTION

This patent application covers several independent but related embodiments or inventions briefly described as follows:

1. Water-evaporation cooling of any gas during any or all portions of the gas-compression process in any gas-compressor system resulting in the evaporated water (steam) being commingled with the original gas being compressed.

2. The use of non-potable, brackish, saline water for water-partial-evaporation cooling with surplus water volumes whereby only a portion of the water is evaporated in any part of the compression cycle of any compression system, and the non-evaporated portion of the water retains all of the dissolved minerals in an increasing concentration for disposal or for processing to extract a mineral byproduct. This prevents the precipitation of minerals or scale inside the steam generator/compressor. Consequently, it is not necessary to use mineral-free, pure water for this steam-generator, water-evaporation-cooled, gas-compressor system.

3. A preferred embodiment of such a steam generator and gas compressor is a twin-screw, rotary compressor which includes a compressor housing with a male screw rotor having helical lobes received in helical grooves in a female screw rotor. The housing includes a gas/air inlet and a series of water-based fluid injectors for injecting the water onto the rotating-screw rotors. Also, the housing includes a gas/air outlet for discharging the compressed steam and gas into areas of compressed steam/gas application.

4. The use of a surplus of water injected into a twin-screw rotary compressor to provide some surplus, non-evaporated water to remain in liquid form to collect in pools of liquid water at the bottom of each progressing cavity. The bottom of each progressing cavity is where the male rotor is fully engaged in the female rotor with the liquid-water pool providing a liquid-sealant barrier to prevent compressed gas from leakage out of one, progressing, compression cavity and into the next, lower, gas-pressure compression cavity.

5. The use of controlled, partial evaporation of the injected water volume of a non-potable, brackish or saline water into a progressing-compression-cavity, twin-screw, rotary compressor with the residual, non-evaporated water collecting as a liquid-water-pool sealant at the bottom of each compression cavity. Such non-evaporated-liquid-water pool contains all of the dissolved minerals with increased, dissolved-mineral concentrations for either disposal or for precipitation and/or extraction of valuable mineral byproducts.

6. The use of the steam-generation/compression process described in Item 5 above for the production of high-value, freshly distilled water from the partial evaporation of salt water or brackish water followed by the condensation of the evaporated water (steam) to achieve effective desalinization of such non-potable, saline/brackish water.

7. In a further preferred embodiment of this invention, the injected-water, evaporation coolant may contain a water-mineral slurry or a non-combustible lubricant/water emulsion to provide improved cavity sealant capability and better lubrication of moving parts to increase the efficiency and effective life and maintenance of these steam-generator and compressor systems. Such water/mineral slurry may consist of a dispersion in water of bentonite and/or related hydrateable-clay minerals with low-shear-strength, or a colloidal dispersion of spherical, glacial silt, or synthetic, inorganic, spherical particles, both acting as micro-ball-bearing lubricants.

8. The gases to be compressed by these steam-generator and gas-compression systems may include a multiplicity of components useful in producing a thermal-energy carrier fluid (TECF) for the in-situ retorting/refining of fixed-bed, carbonaceous deposits (FBCD) such as oil shale, volatile coal beds, tar sands, heavy-oil deposits, carbonaceous shale, etc. Such TECF components may include steam (i.e., $H_2O$), air, oxygen-enriched air, oxygen, carbon dioxide ($CO_2$), carbon monoxide (CO), methane, hydrogen, etc.

In view of the foregoing, it is a primary objective of the subject invention to provide a gas/air-compressor system for compressing air, oxygen, oxygen-enriched air, or other gases, for delivering a moderate-to-high-temperature, moderate-to-high-pressure fluid (i.e., TECF) for in-situ-retorting and refining of oil shale, volatile coals, tar sands, heavy oil and other related hydrocarbon deposits and for a multitude of gas-compression applications.

Another object of the invention is to provide a continuous use of a water/mineral slurry or emulsion that is a sealant, a lubricant and also a coolant for a compressor during the compression cycle.

Still another object of the compressor system is the use of the water/mineral slurry, or non-combustible lubricant/water emulsion to create a non-combustible and non-reactive compression system for the compression of oxygen-containing fluids.

BRIEF DESCRIPTION OF THE DRAWINGS

The accompanying drawings illustrate complete preferred embodiments in the present invention according to the best modes presently devised for the practical application of the principles thereof, and in which.

DETAILED DESCRIPTION OF THE PREFERRED EMBODIMENTS

Figure 1:
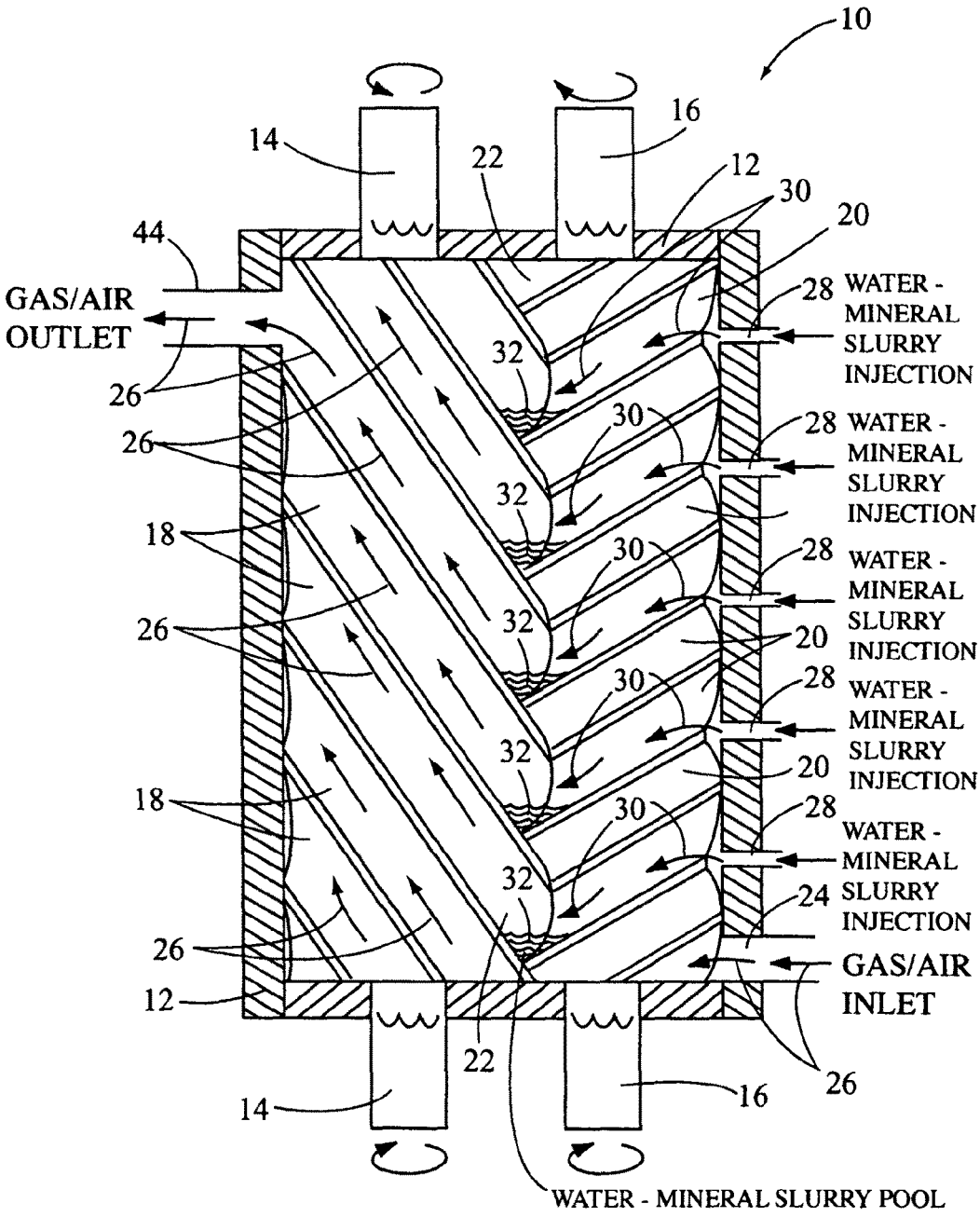
FIG. 1 is a cross-sectional view of the gas/air compressor system, using the preferred embodiment, with a compressor housing having twin-screw rotors with gas/air inlet, water/mineral-slurry or water/lubricant-emulsion injectors and a gas/air outlet.

In FIG. 1, the preferred embodiment of the subject gas/air compressor system is shown having general reference numeral 10. The compressor system 10 includes a compressor housing 12 with a male screw rotor 14 meshing with a female screw rotor 16. The male screw rotor 14 includes helical lobes 18 received in helical grooves 20 in the female screw rotor 16.

The compressor system 10 may be designed to provide a high, gas-compression pressure ratio. In this design, the changing depth of the male helical lobes 18 meshing in the helical grooves 20, and the changing circumferential length of a cavity 22 between the adjacent intermeshing rotors with tapered rotor diameters create a progressively decreasing cavity volume for gas compression with the rotor's rotation. This feature determines the pressure ratios created in the cavity 22.

In this drawing, a gas/air inlet 24 is shown for receiving a gas/air stream, shown as arrows 26 inside the housing 12 and compressed in the progressing cavity created between the meshing areas of the male and female rotors 14 and 16. A plurality of spaced-apart, water or water/mineral injection ports 28 is shown for spraying water or a water/mineral slurry, or emulsion, shown, as arrows 30, in the rotating helical grooves 20. The water or water/mineral slurry 30 accumulates in a slurry pool 32 just above the meshing of the male screw rotor 14 into the female screw rotor 16. The gas/air stream 24 in the cavity 22 is progressively compressed in a semi-positive-displacement-like compression. In this compressor system 10, the water/mineral slurry or emulsion 30 volume injection rate, greater than the evaporation rate, can be used to create a desired volume of the slurry pool 34 to lubricate and create a partial liquid seal between the male rotor 14 and female rotor 16 at their points of intermeshing. The resulting compressed, gas/air stream 26 cooling from the water evaporation will create a pressure/temperature profile approximately as illustrated by the lowest dashed line in FIG. 2 or by the area between the two lower dashed lines in FIG. 2.

Figure 2:
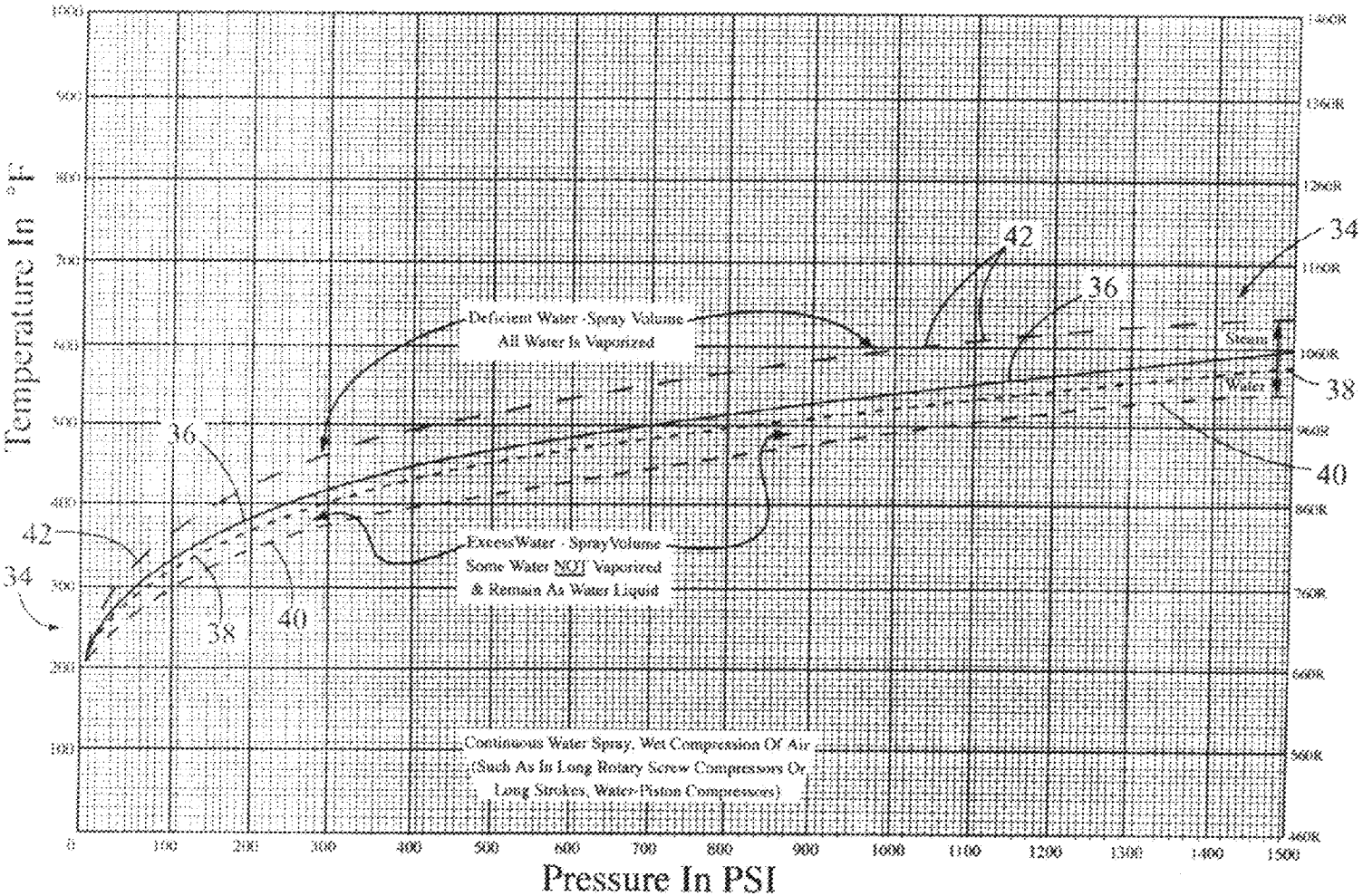
FIG. 2 illustrates a pressure/temperature profile of the water-evaporation-cooled, compressed gas in the subject compressor system.

In FIG. 2, a pressure/temperature profile, having general reference numeral 34, of the compressed gas/air stream 26 in the compressor system 10 is shown wherein the water/mineral slurry 30 is sprayed continuously throughout the compression cycle for evaporative cooling. A solid middle line 36 represents a curve wherein the slurry spray volume rate exactly equals an evaporation volume rate so that no unevaporated liquid water remains and no additional water can be evaporated. Two lower dashed lines 38 and 40 in this drawing represent a condition where excess water is injected and unevaporated liquid water is present in the slurry pools 32 just above the point of the intermeshing rotors, as shown in FIG. 1. An upper dashed line 42 in this drawing represents conditions where insufficient water is injected into the compressor housing 12, resulting in no unevaporated water droplets or bulk water existing in the slurry pools 32 in the compressor system 10.

Figure 3:
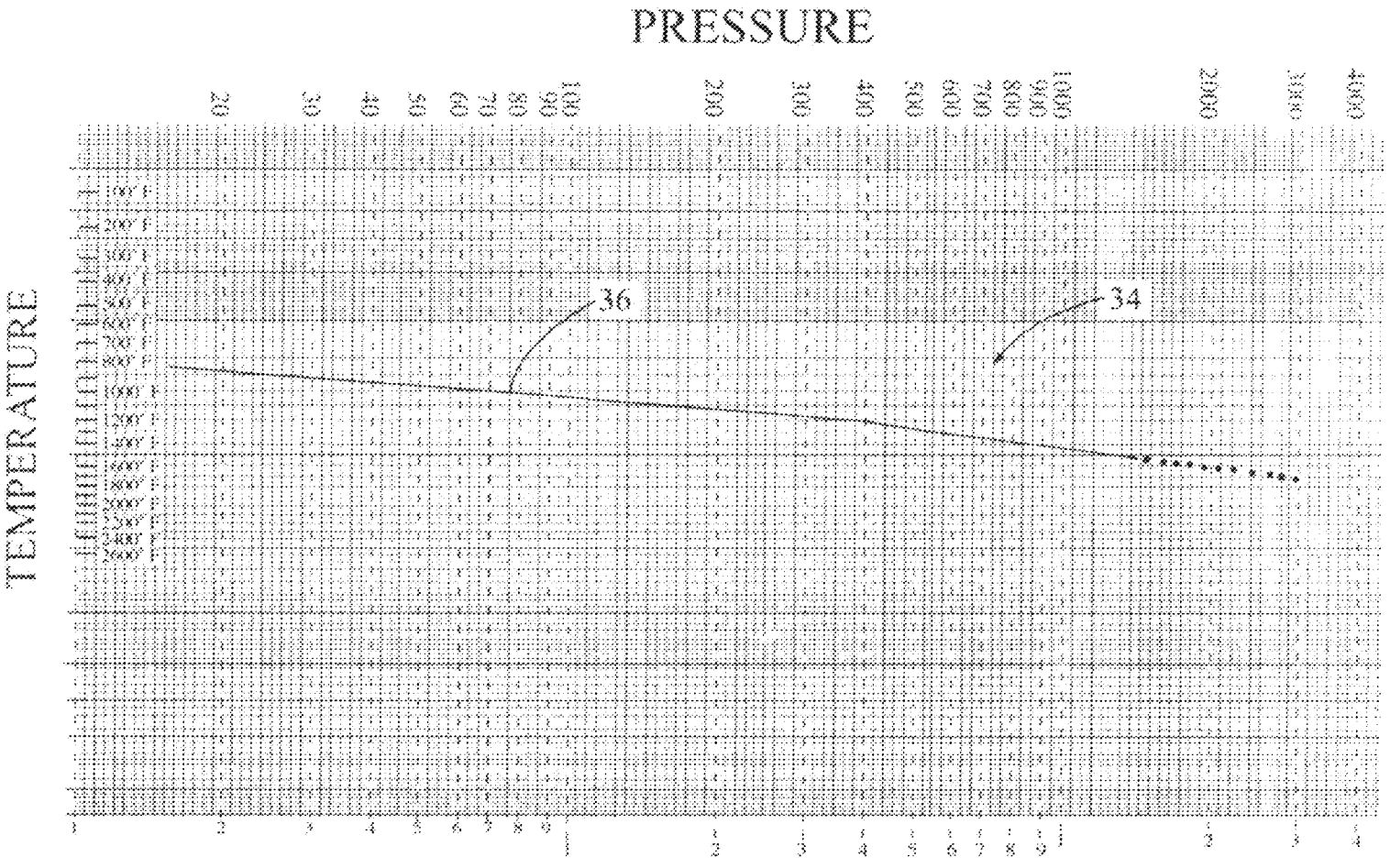
FIG. 3 shows a solid-line data of the pressure/temperature profile replotted on a log/log plot.

In FIG. 3, a solid-line data of FIG. 2 is shown and replotted on a log/log plot format. This type of format illustrates a flattened curve, or nearly a straight line, of the temperature and pressure shown in FIG. 2 and extended upwardly to pressures of 3,000 psi and temperatures of 1,200° Rankine, or about 800° Fahrenheit, can be projected.

To facilitate the lubrication between the male and female screw rotors 14 and 16 and to decrease the rate of water-slurry-sealant leakage between the meshing surfaces of the two rotors, a non-combustible, temperature-stable mineral, such as bentonite clay, or other hydrateable clay minerals, can be mixed with water to be injected as the water/mineral slurry 30, as shown in FIG. 1. Such minerals, dispersed in water and injected through the injector ports 28, will provide increased liquid viscosity and increase the sealant quality thereby decreasing the slurry leakage rate. Also, the low, mineral-platelet shear strength of bentonite and similar clay minerals will improve the lubrication between the two rotors. Alternatively, a colloidal suspension of an extremely fine-grained, nearly spherical grains of glacial silt from glacier outflow, or synthetically produced, small, micro-sized spheres (micro-ball-bearings) can be used instead of clay minerals in the water/mineral slurry 30 as both a lubricant and sealant. Also, silica gel, mica, and other thin mineral platelets in colloidal dispersions, or true solutions, can be used. Alternatively, a non-combustible lubricant in a water emulsion may be used.

It should be noted, an adequate amount of excess water must be maintained to achieve the desired, hydrated-clay-mineral, colloidal-mineral, or lubricant-emulsion concentration disbursed in the water for both the desired lubrication and liquid sealant qualities. In most applications, the compressed gas/air team 26 will have a temperature below 600° F. and usually below 500° F., or in some cases can below 400° F., as shown in FIGS. 2 and 3. A preferred turbulent flow, instead of laminar flow, can maintained in the water/mineral slurry 30 by creating dimples or depressions in the meshing rotor surfaces to minimize the leakage volume rate, as illustrated in FIG. 1. This leakage of water/mineral slurry 30 flows in a direction from the higher pressure gas/air stream 26 next to a gas/air outlet 44 in the cavity in the upper portion of the housing down to the cavity in a lower portion of the housing and next to the lower-pressured, gas/air inlet 24.

As a preliminary test, a reservoir of oil-lubricant coolant in an existing, oil-spray-lubricated, twin-screw, rotor compressor can be drained, and the oil replaced with the water/mineral slurry 30. The slurry 30 must be injected with sufficient volume into the compressor housing 12 to have an adequate surplus of water in excess of the evaporation rate in order to maintain the slurry pools 32 at the intersections of the male and female rotors, as shown in FIG. 1, and thereby prevent dehydration of the clay minerals in the slurry and provide an adequate cavity sealant. From these preliminary tests, using an existing oil-cooled, twin-screw compressor, operated in a water-injection mode (i.e., without oil), data can be collected to more properly design a desired, continuous, water-injected and evaporation-cooled, twin-screw rotor, gas/air compressor system 10.

Figure 4:
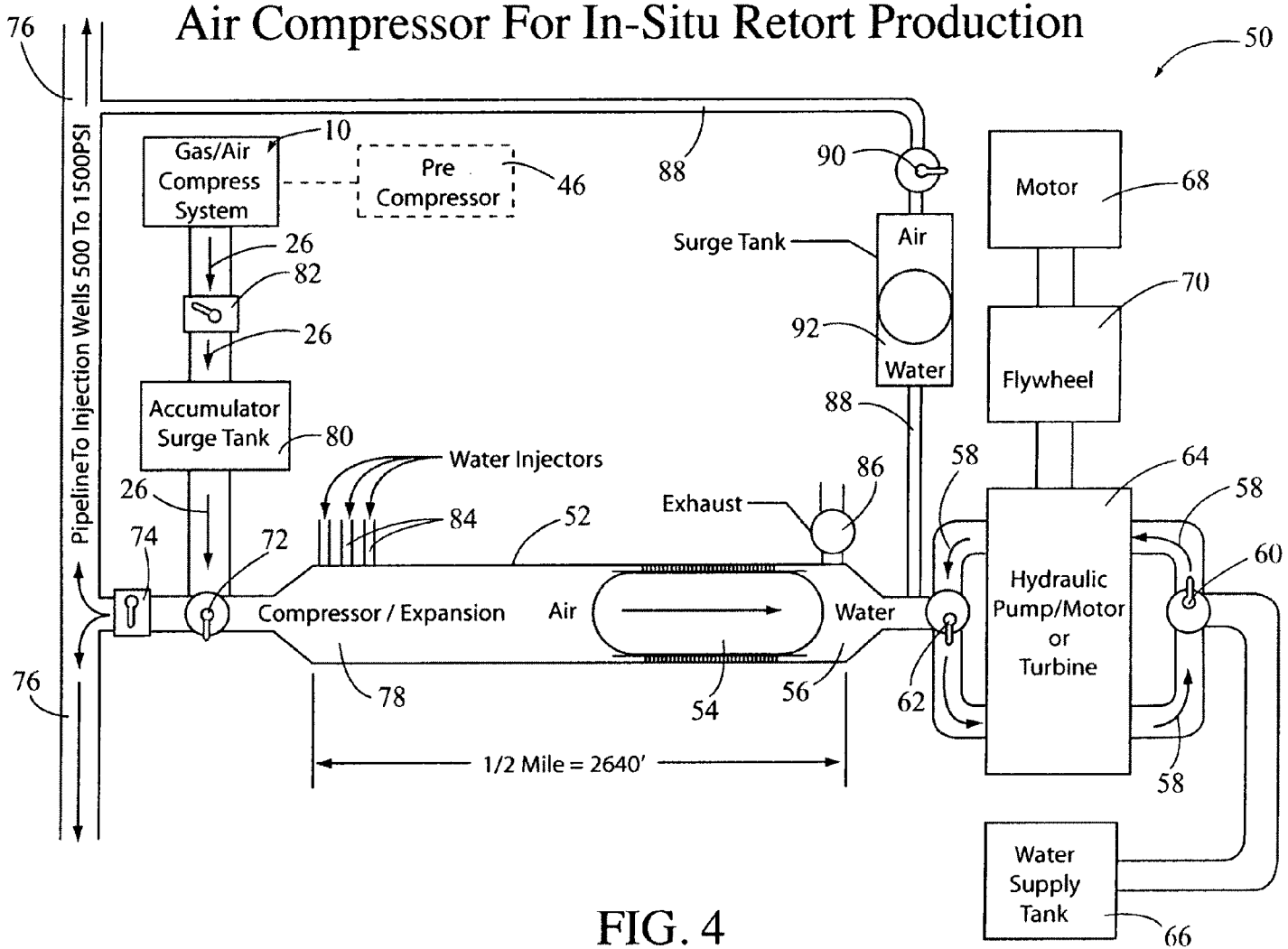
FIG. 4 illustrates a block diagram of an optional final stage of gas/air compression using a typical example of a half-mile-long, 2-foot-internal-diameter pipe cylinder, providing about 8,300-cubic-foot volume for compression of the gas.

In the operation of the subject compressor system 10, it can be economically advantageous to use a first stage, pre-compressor 46, shown in FIG. 4. The pre-compressor 46 can be a centrifugal turbine compressor or an axial-flow turbine to adiabatically compress the gas/air stream 26 from 1 atm up to about 2.5 atm (i.e., 37.5 psi) or 6.25 atm [i.e., (2.5×2.5=6.25)×15=93.75 psi] as a pre-compression inlet feed into the gas/air inlet 24 of the compressor housing 12 in FIG. 1. In this example, the compressor system 10 will act as a second-stage and/or a third-stage compressor to further compress the gas/air stream 26 up to a desired final pressure.

As an example and referring to the profile curve 36 shown in FIG. 2, the second-stage, gas/air-compressor system 10, with a 3.5-times compression ratio, can compress a 37.5 psi inlet pressure gas up to a 130 psi outlet pressure at about 300° F. to 350° F. Also, a 93.75 psi, inlet pressure can compress the gas up to a 328 psi outlet pressure at about 380° F. to 430° F. Furthermore, by using the compressor system 10 as a third-stage compressor with a 3.5-compression-ratio, the second-stage, 130-psi-pressured gas can be compressed in the third stage to 460 psi at about 400° F. to 450° F., and the second-stage, 328-psi-pressured gas can be compressed in the third stage to 1,150 psi at about 510° F. to 560° F.

Obviously, the compressor system 10 can be designed to operate in broader pressure and temperature ranges. With a 10-times-compression-ratio design, the gas/air stream can have a 30 or 50 psi inlet pressure with gas compression up to 300 or 500 psi outlet pressure, respectively, with a consequent temperature range from 380 to 450 degrees F., as shown in FIG. 2. As another example, when using the pre-compressor 46 as a first-stage, 30 to 60-psi compressor and a 5-times-compression-ratio compressor system 10 as a second-stage and third-stage compressor, then the second-stage outlet pressure would be 150 psi to 300 psi, and the third-stage outlet pressure will be 750 psi to 1,500 psi, respectively, with corresponding temperatures of about 460° F. to 560° F. (see FIG. 2).

Other combinations of compressors, with special designed compression ratios, can be designed and connected in series to achieve a desired outlet pressure. For example, if the pre-compression, inlet pressure to the second-stage compressor system 10 can be continually varied from 30 psi to 60 psi, this will provide any desired outlet pressures from 750 psi to 1,500 psi from the second-stage-plus-third-stage compressors of 5-times-compression-ratio, each with outlet temperatures ranging from 470° F. to 570° F., respectively, as shown in FIG. 2.

This water-evaporation-cooled gas compressor may be considered as a steam generator to produce the steam component desired for our thermal-energy carrier fluid (TECF). In the process of this injected coolant water being partially evaporated as it flows downward through a series of pools of water/mineral slurry accumulated at the bottom of each upward-progressing cavity in the twin-screw rotary compressor (see FIG. 1), the water evaporation process will result in increasing the concentration of mineral salts dissolved in this water. If the initially dissolved, mineral-salt concentration is low enough and the water injection and outflow rate are high enough, the mineral concentration in the partially evaporated water can be kept low enough to prevent precipitation of any minerals from this evaporating solution. By maintaining this water at a non-precipitating, dissolved-mineral concentration, a non-potable, brackish, produced formation water can be used for water injection into this steam-generator/compressor system.

This process requires operating in the temperature/pressure region below the solid line in FIG. 2, and probably between the two dashed lines below the solid line in FIG. 2. If the injected water rate is too low, resulting in the total evaporation of all the water, as illustrated by the dotted line above the solid line in FIG. 2, then mineral precipitates and scale will be deposited on the compressor surfaces, unless the water is very pure, like distilled water. High-speed, centrifugal-turbine or axial-flow-turbine compressors cannot operate in the presence of any liquid droplets, and thereby must operate in the temperature/pressure region above the solid line in FIG. 2. Consequently, such turbine compressors would require very pure (i.e., distilled) water for total water-evaporation coolant. Almost any dissolved mineral in the water would prohibit cooling with the turbine compressors, thereby limiting such cooling to interstage cooling between adiabatic compression stages.

The ability to use non-potable, brackish, formation water for this continuous, intra-stage, partial, water-evaporation cooling provides a major value in the use of the proposed, twin-screw rotary compressors, as illustrated in FIG. 1, or the large-volume cylinder compressors, as shown in FIG. 4, and in the patent applications to which this is a Continuation-In-Part. Furthermore, the water evaporated in this compressor-coolant process will eventually be condensed either in the injected formation or in the production equipment attached downstream from the producing wells. Consequently, this condensed (i.e., distilled) water is a valuable by-product of this process. Also, concentrated, dissolved minerals in the water outflow from the compressor may be processed to extract selected, precipitated minerals as valuable by-products from this process. Of particular interest is the presence of the 1,500 ppm to 3,000-ppm-nahcolite ($NaHCO_3$) formation water produced from oil shale which can be concentrated by our compressor's partial-evaporation coolant process. When this concentrated nahcolite solution, at pressures and temperatures shown by the dashed line in FIG. 2, is depressurized, a nahcolite precipitate will be formed which can be used to produce soda ash as a valuable by-product. Consequently, both mineral precipitates and distilled water can be by-products of value which are produced from the partial evaporative cooling of compressor-injected, non-potable, brackish, formation water.

The compressor system 10, as shown in FIG. 1, can be operated in reverse as a twin-screw, rotor-expander to extract shaft horsepower from expanding vapors produced from an in-situ, retorting, production well bore, as described in the earlier filed cited patent applications, and simultaneously collect the fractionated-condensate liquids condensed during the expansion process. In this reverse-cycle expansion process, the water/mineral injection ports 28, shown in FIG. 1, can be used as condensate-fractionation taps to drain off the condensate liquid fractions as they are produced during the expansion. In this expansion-cycle application, the condensed hydrocarbon liquids will form liquid pools, similar to slurry pools 32, at the points of the meshing the male and female rotors 14 and 16 and thereby provide a liquid, gas/vapor sealant and lubricant for the rotors. Also, using the subject compressor system 10 as a reverse cycle expansion process, the system can be used in large scale electric power plants for generating shaft horsepower from the expansion of both the compressor steam and the air combustion products.

In FIG. 4, an optional alternative, final stage or third stage gas/air compressor system is shown having general reference numeral 50. This compressor system 50 is connected to the subject gas/air compressor system 10. The compressor system 50 is illustrated having a ½-mile (i.e., 2,640-ft) long cylinder 52 or pipeline with a 24 inch internal diameter to provide about 8,300-$ft^3$ cylinder volume for compression. Obviously, the length of the cylinder 52 can vary in a range of less than a ¼ mile to 1 mile and greater. The 8,300-$ft^3$ cylinder volume may be pre-charged with 350 psi compressed air from the gas/air compressor system 10 of FIG. 1, thereby pushing a water/air separator piston 54 to a first end 56 of the cylinder 52. At this point, water, shown as arrows 58 is pumped through values 60 and 62 by a combination hydraulic pump/motor 64 or turbine and thereby displaces the water/air separator piston 54 (i.e., a modified pipeline pig) along the cylinder 52, thereby compressing the air to the injection well-bore pressure. The valve 60 is connected to a water supply tank 66. The pump/motor 64 is driven by a large motor 68 with flywheel 70.

The compressed air in the cylinder 52 flows through a valve 72, through a check valve 74 and into a pipeline 76 connected to injection wells. The injection wells are not shown in the drawings. When the water/air separator piston 54 (i.e., pipeline pig) reaches a second end 78 of the ½-mile-long compression cylinder 52, valves 60 and 62 are switched to flow water at 350 psi from the compression cylinder 52 through the hydraulic pump/motor 64 or turbine to generate shaft horsepower and then flow back into the water-supply tank 66. In this operation, valve 72 is connected to the gas/air compressor system 10 via an accumulator surge tank 80 and check valve 82. The compressor system 10 is used to recharge the cylinder 52 at 350 psi in preparation for the next compression stroke. The cylinder 52 also includes water injectors 84 for cooling compressed air exiting the valve 72 and an exhaust port 86 for discharging exhaust vapors during the return stroke of the piston 54. Also shown in this drawing is a surge line 88 with a valve 90 and air/water surge tank 92 connected to the pipeline 76 and the first end 56 of the cylinder 52 for controlling fluid pressure surge during the operation of the optional compressor system 50 of FIG. 4.

The 350 psi (±30%) discharge pressure of the compressor system 10, as discussed under FIGS. 1-3 can be boosted to a desired well-bore injection pressure by either (1) the addition of the pre-compressor 46 designed for this higher pressure, or (2) by a water-piston-driven displacement ball (or pipeline pig) in a long pipe (cylinder) laid on (or under) sloping ground, as shown in FIG. 4.

If there is an economy of scale for air compressors, then one or more large-diameter, TECF-compressed-gas/air pipelines may be used to connect all of the primary drill sites along a pipeline right-of-way to a small number of compressor stations. For example, on each such 1-mile-long pipeline, there could be a single compressor station producing 224,000 scfm (i.e., 320 mmscf/d) at 750 psi of compressed, 40% $O_2$, oxygen-enriched air, or twice the volume rate of standard 20% oxygen air. Alternatively, centralized compressor stations of double this size may be built at 2-mile intervals along such pipeline right-of-ways or at any other spacing intervals and corresponding sizes. The compressed-gas/air pipeline also serves as a large-volume accumulator to smooth out any pressure surges in the line.

Furthermore, these steam-generator/compressor systems, as illustrated in FIGS. 1 and 4 and described herein, may be used as a Continuation-In-Part of the hydro, internal-combustion steam engine (ICS cycle), as illustrated in FIGS. 19*a*, 19*b*, 20*a*, 20*b* and described on pages 287 to 298 of the Utility patent application, titled "Integrated In-Situ Retorting and Refining of Oil Shale," as filed on Jun. 19, 2006, Ser. No. 11/455,438, by Gilman A. Hill and Joseph A. Affholter. For large, electric-power-generation plants, very large compression cylinders of 8,300 cu ft volume (i.e., ½-mile long×2-ft I.D. pipeline) to 66,350 cu ft volume (i.e., 1-mile long×4-ft I.D. pipeline) may be most desirable as very high volume, long-stroke cylinders in a hydro, internal-combustion steam engine (ICS cycle). Such large, electric-power plants, using non-potable, brackish water for partial-evaporation steam generation, would produce very large volumes of condensed distilled water as a high-value byproduct from the power-plant operations.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A steam generator, gas/air compressor system used for compressing a gas/air stream of oxygen, oxygen-enriched air and other combustible gases and delivering a moderate-to-high-temperature, moderate-to-high-pressure fluid for in-situ retorting and refining of hydrocarbons, for large, electric-power-generation plants and similar applications, the compressor system comprising:

a compressor housing for compressing the gas/air stream therein;

a gas/air inlet in said housing for receiving the gas/air stream therein to be compressed;

at least one water-based fluid injector in said housing;

a water slurry, said water slurry injected through said fluid injector into said housing, said water slurry acting as a sealant, a lubricant and a coolant during the compression of the gas/air stream, said water slurry includes non-potable, brackish, saline water, the saline water in said water slurry partially evaporated during the compression of the gas/air stream in said compressor housing, whereby the non-evaporated saline water includes progressively increasing concentrations of dissolved minerals therein of which some of the dissolved minerals in the non-evaporated saline water can be extracted as a downstream mineral byproduct and can be disposed of as a waste product; and a gas/air outlet in said housing for discharging the compressed gas/air stream under pressure;

whereby a portion of said water slurry is evaporated during the compression of the gas/air stream, the steam commingling with the compressed gas/air stream, whereby the steam in the gas/air stream can be condensed to distilled water as a downstream byproduct from said gas/air outlet.

2. The compressor system as described in claim 1 further including a plurality of water-based fluid injectors in said housing for introducing said water slurry therein.

3. The compressor system as described in claim 1 wherein said water slurry is non-combustible and non-reactive to the combustion supporting gases in the gas/air stream.

4. The compressor system as described in claim 1 wherein said compressor housing includes a screw male rotor, said male rotor having helical lobes, said male rotor rotatably mounted in said housing and a screw female rotor, said female rotor having in helical grooves therein, the helical lobes of said male rotor slidably received in the helical grooves of said female rotor, said female rotor rotatably mounted in said housing.

5. The compressor system as described in claim 4 wherein a portion of non-evaporated water slurry in said compressor housing collects as a slurry pool above the meshing of said male rotor into said female rotor, said slurry pool lubricating, cooling and acting as a sealant between the intermeshing rotors during the compression of the gas/air stream.

6. The compressor system as described in claim 4 wherein said male and female rotors have a 3 to 7 times compression ratio for compressing the gas/air stream in said housing.

7. A steam generator, gas/air compressor system used for compressing a gas/air stream of oxygen, oxygen-enriched air and other combustion supporting gases and delivering a moderate-to-high-temperature, moderate-to-high-pressure fluid for water-injected combustion and energy-extraction expansion in electric-power-generation plants and similar applications, the compressor system comprising:

a compressor housing;

a screw male rotor, said male rotor having helical lobes, said male rotor rotatably mounted in said housing;

a screw female rotor, said female rotor having in helical grooves therein, the helical lobes of said male rotor slidably received in the helical grooves of said female rotor, said female rotor rotatably mounted in said housing;

a gas/air inlet in said housing for receiving the gas/air stream therein to be compressed;

at least one water-based fluid injector in said housing;

a non-potable, brackish, saline water slurry, said saline water slurry injected through said fluid injector and into the grooves of said rotating female rotor, said saline water slurry acting as a sealant, a lubricant and a coolant for said male and female rotors during the compression of the gas/air stream; and a gas/air outlet in said housing for discharging the compressed steam and gas/air stream under pressure;

whereby a portion of said saline water slurry is evaporated during the compression of the gas/air stream thus creating steam, the steam commingling with the compressed gas/air stream during compression, whereby the steam in the gas/air stream can be condensed to distilled water as a downstream byproduct.

8. The compressor system as described in claim 7 whereby said saline water slurry is partially evaporated as steam during the compression of the gas/air stream in said compressor housing, whereby said non-evaporated saline water slurry includes dissolved minerals therein, the dissolved minerals in said non-evaporated saline water slurry are extracted from the gas/air stream as a downstream mineral byproduct.

9. The compressor system as described in claim 7 wherein a portion of non-evaporated saline water slurry in said compressor housing collects as a slurry pool above the meshing of said male rotor into said female rotor, said slurry pool lubricating, cooling and acting as a sealant between the intermeshing rotors during the compression of the gas/air stream.

10. The compressor system as described in claim 7 wherein said saline water slurry is non-combustible and non-reactive to combustible gases in the gas/air stream.

11. The compressor system as described in claim 6 further including a plurality of water-based fluid injectors in said housing for introducing the saline water slurry therein.

12. The compressor system as described in claim 7 wherein said male and female rotors have a 3 to 7 times compression ratio for compressing the gas/air stream in said housing.

13. A steam generator, gas/air compressor system used for compressing a gas/air stream of oxygen, oxygen-enriched air and other combustible gases and delivering a moderate-to-high-temperature, moderate-to-high-pressure fluid to a pipeline, the pipeline connected to one or more injection wells, the compressed gas/air stream is used to produce a thermal-energy, carrier fluid introduced into the injection wells for in-situ retorting oil shale, volatile coal beds, tar sands, heavy oil and other hydrocarbon or carbonaceous deposits, the compressor system comprising:

a compressor housing;

a screw male rotor, said male rotor having helical lobes, said male rotor rotatably mounted in said housing;

a screw female rotor, said female rotor having in helical grooves therein, the helical lobes of said male rotor slidably received in the helical grooves of said female rotor, said female rotor rotatably mounted in said housing;

a gas/air inlet in said housing for receiving the gas/air stream therein to be compressed;

a plurality of water-based fluid injectors in said housing;

a water/mineral slurry including a hydrateable clay mineral, said slurry injected through said water-based injectors and into the grooves of said rotating female rotor, said water/mineral slurry acting as a sealant, a lubricant and a coolant for said male and female rotors during the compression of the gas/air stream, said water/mineral slurry is non-combustible and non-reactive to combustion supporting gases in the gas/air stream; and a gas/air outlet in said housing for discharging the compressed gas/air stream under pressure and into the pipeline connected to the injection wells used in the in-situ retorting process.

14. The compressor system as described in claim 13 wherein the hydrateable clay mineral in the water/mineral slurry is bentonite clay.

15. The compressor system as described in claim 13 wherein the mineral in the water/mineral slurry contains a fine-grained, glacial slit of rounded spherical shapes.

16. The compressor system as described in claim 13 wherein the water/mineral slurry contains synthetically produced, small, micro-sized spheres acting as micro-ball-bearings.

17. The compressor system as described in claim 13 wherein said male and female rotors have a 3 to 4 time compressor ratio for compressing the gas/air stream in said housing and an inlet gas/air stream pressure in a range of 30 to 90 psi.

18. The compressor system as described in claim 13 wherein an outlet gas/air stream pressure is in a range of 100 psi to 300 psi at a temperature range of 300 to 400 degrees F.

19. The compressor system as described in claim 13 wherein the water in the water/mineral slurry is a non-potable, brackish water, whereby partial evaporation of water from said slurry provides compression cooling, distilled water and recoverable mineral salts.

20. A steam generator, gas/air compressor system used for compressing a gas/air stream of oxygen, oxygen-enriched air and other combustible gases and delivering a moderate-to-high-temperature, moderate-to-high-pressure fluid to a pipeline, the pipeline connected to one or more injection wells, the compressed gas/air stream is used to produce a thermal-energy carrier fluid introduced into the injection wells for in-situ retorting oil shale, volatile coal beds, tar sands, heavy oil and other hydrocarbon or carbonaceous deposits, the compressor system comprising:

a compressor housing;

a screw male rotor, said male rotor having helical lobes, said male rotor rotatably mounted in said housing;

a screw female rotor, said female rotor having in helical grooves therein, the helical lobes of said male rotor slidably received in the helical grooves of said female rotor, said female rotor rotatably mounted in said housing;

a gas/air inlet in said housing for receiving the gas/air stream therein to be compressed;

a plurality of water-based fluid injectors in said housing;

a water/mineral slurry including a hydrateable clay mineral, said slurry injected through said water-based fluid injectors and into the grooves of said rotating female rotor, said water/mineral slurry acting as a sealant, a lubricant and a coolant for said male and female rotors during the compression of the gas/air stream, said water/mineral slurry is non-combustible and non-reactive to combustion supporting gases in the gas/air stream;

a gas/air outlet in said housing for discharging the compressed gas/air stream under pressure and into the pipeline connected to the injection wells used in the in-situ retorting process; and a pre-compressor acting as a first stage compressor and connected to said gas/air inlet for providing an increase in pressure to the gas/air stream.

21. The compressor system as described in claim 20 wherein said male and female rotors have a 3-to-7-times compression ratio for compressing the gas/air stream in said housing.

22. The compressor system as described in claim 20 wherein an outlet gas/air stream pressure is in a range of 300 psi to 750 psi at a temperature range of 350 to 500 degrees F.

23. The compressor system as described in claim 20 wherein the water in the water/mineral slurry is a non-potable, brackish water, whereby partial evaporation of said slurry from said gas/air outlet in said housing provides compression cooling, distilled water and concentrated solutions of mineral salts.

* * * * *

UNITED STATES PATENT AND TRADEMARK OFFICE

CERTIFICATE OF CORRECTION

PATENT NO. : 7,993,110 B1
APPLICATION NO. : 11/899905
DATED : August 9, 2011
INVENTOR(S) : Hill It is certified that error appears in the above-identified patent and that said Letters Patent is hereby corrected as shown below:

On the title page item (76), add -- Joseph A. Affholter, Coleman, MI (US) --

Signed and Sealed this
Twenty-second Day of November, 2011

David J. Kappos

David J. Kappos
*Director of the United States Patent and Trademark Office*